US006415956B1

(12) United States Patent
Havlovitz

(10) Patent No.: US 6,415,956 B1
(45) **Date of Patent: *Jul. 9, 2002**

(54) HAND HOLDABLE PUMP SPRAY APPARATUS

(75) Inventor: Paul M. Havlovitz, Dublin, OH (US)

(73) Assignee: OMS Investments, Inc., Santa Monica, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/723,067

(22) Filed: Nov. 27, 2000

Related U.S. Application Data

(63) Continuation-in-part of application No. 09/457,171, filed on Dec. 8, 1999, now Pat. No. 6,170,706.

(51) Int. Cl.[7] ..... B67D 1/16

(52) U.S. Cl. ..... 222/109; 222/340; 222/518; 222/530; 239/373; 417/571; 417/510; 251/353

(58) Field of Search ..... 222/109, 340, 222/323, 518, 545, 528, 464.1, 382, 530; 239/373, 333, 331, 329; 417/571, 566, 540, 471; 251/353, 354

(56) References Cited

U.S. PATENT DOCUMENTS

| | | | | |
|---|---|---|---|---|
| 665,914 | A | | 1/1901 | Kindermann |
| 1,671,779 | A | | 5/1928 | Pearsons |
| 1,681,845 | A | | 8/1928 | Dilley et al. |
| 2,060,297 | A | | 11/1936 | Fox |
| 2,232,522 | A | | 2/1941 | Gray |
| 2,474,748 | A | | 6/1949 | McMurray |
| 2,545,319 | A | | 3/1951 | Sundholm |
| 3,002,699 | A | | 10/1961 | Pinke |
| 3,092,330 | A | | 6/1963 | Ridenour et al. |
| 3,730,398 | A | | 5/1973 | Goda |
| 4,174,055 | A | | 11/1979 | Capra et al. |
| 4,192,464 | A | * | 3/1980 | Chow ..... 239/373 |
| 5,373,973 | A | | 12/1994 | Foster |
| 5,469,993 | A | | 11/1995 | Hauf et al. |
| 5,485,942 | A | | 1/1996 | Foster |
| 5,553,750 | A | | 9/1996 | Foster |
| 5,601,211 | A | | 2/1997 | Foster |
| 5,609,272 | A | | 3/1997 | Brass et al. |
| 5,649,664 | A | | 7/1997 | Brass et al. |
| 5,651,908 | A | | 7/1997 | Mansfield |
| 5,810,211 | A | | 9/1998 | Shanklin et al. |
| 5,816,447 | A | | 10/1998 | Shanklin et al. |
| D402,205 | S | | 12/1998 | Shanklin et al. |
| 5,860,574 | A | | 1/1999 | Shanklin et al. |
| D407,312 | S | | 3/1999 | Shanklin et al. |
| 5,918,782 | A | | 7/1999 | Shanklin et al. |
| 5,938,116 | A | | 8/1999 | Restive et al. |
| 6,170,706 | B1 | * | 1/2001 | Havlovitz ..... 222/109 |

* cited by examiner

*Primary Examiner*—William C. Doerrler
*Assistant Examiner*—Dinh Q. Nguyen
(74) *Attorney, Agent, or Firm*—Jones, Day, Reavis & Pogue

(57) ABSTRACT

A hand holdable pump spray apparatus is disclosed where the pump mechanism is in the hand holdable wand rather than in a spaced apart liquid container. The wand may be held with one hand while a pump handle is extended with the other hand. This creates a pressure differential which allows liquid to flow from the container, passed a check valve and into the wand. After filling, a biased spring provides a force against the liquid creating a higher pressure in the wand than ambient pressure. This closes the check valve. When an operator depresses an actuator, another valve opens allowing the liquid in the wand to be ejected through a nozzle.

10 Claims, 11 Drawing Sheets

HAND HOLDABLE PUMP SPRAY APPARATUS

CROSS-REFERENCE TO RELATED APPLICATION

This application is a continuation-in-part of applicant's application entitled Hand Holdable Pump Spray System, Ser. No. 09/457,171, filed Dec. 8, 1999 now U.S. Pat. No. 6,170,706.

BACKGROUND OF THE INVENTION

1. Field of the Invention

The present invention relates to a hand holdable pump spray apparatus and more particularly to a hand holdable pump spray which is reliable, easy to use, safe and inexpensive.

2. Description of the Related Art

Non-aerosol pump spraying devices have been developed primarily to eliminate the use of propellants which have a detrimental effect on the environment and to eliminate the use of pressurized containers which pose a safety hazard. Pressurized containers may explode and cause injury, and when the containers have ingredients such as insecticide, weed and grass killer and fertilizer, there may be undesirable environmental affects. Examples of non-aerosol pump spray apparatus may be seen by reference to U.S. Pat. Nos. 5,938,116; 5,918,782; 5,860,574; 5,816,447; 5,810,211 and 4,174,055.

A drawback to all of such non-aerosol pump apparatus is that the pump device is located in the container having the liquid to be pumped. There is then a flexible tube connecting the container to a hand holdable spray device or "wand". Typically, the container is sold as a disposable unit to be discarded when there is no more liquid to be pumped. This results in a relatively high cost to both the manufacturer and the consumer because the pump mechanism, located within the container, is also discarded along with the container. Another problem of pump-in-container designs is that the hand held wand must be set down or held in an awkward position when the pump is to be operated because two hands are necessary to manipulate the pump. For example, when it comes time to operate the spraying device, the pump must be activated to pressurize at least part of the system. Usually this means there is a need to pull upwardly on a handle attached to a piston located in the container. While this is done with one hand, the other hand must hold the container "down" to counteract the upward pull on the handle. Hence, it is difficult to also hold the wand at the same time.

There are also safety issues made especially more relevant because of the nature of the liquid being sprayed. First, there is a need to have a sealed container when it is shipped from the factory and again when it is stored by a consumer. Further, there may also be a safety problem regarding pressurized liquid contained in the flow path from the container to the spray device.

The numerous prior attempts to improve upon non-aerosol pump spray devices have yet to produce an optimal system.

BRIEF SUMMARY OF THE INVENTION

The difficulties encountered by the previous devices have been overcome by the present invention. What is described here is a hand holdable pump spray apparatus comprising a generally tubular hand holdable housing having first and second end portions spaced apart from a container of liquid to be sprayed, a piston movable in the housing, a handle connected to the piston adapted to be gripped by a user to move the piston toward one end of the housing, a spring located in the housing between the piston and the end of the housing to bias the piston toward the other end of the housing, a chamber formed in the housing between the piston and the other end of the housing, a first valve positioned between the container and the chamber, a nozzle, another valve located between the nozzle and the first valve, and an actuator for opening the second valve whereby liquid in the chamber may be ejected through the nozzle.

There are a number of advantages, features and objects achieved with the present apparatus not available in prior devices. For example, one advantage is that the present invention provides a non-aerosol hand holdable pump spray apparatus having the pump contained in the wand, thereby eliminating prior potential safety hazards relative to pressurized liquid in the flow path. Another advantage of the present invention is that it enables elimination of various previously required components. Yet another advantage of the present invention is that the pump spray wand and the container combination is relatively inexpensive and that the container is disposable after use but the pump mechanism in the wand is separate and may be reused. Still another feature of the present invention is to provide a simple container valve whose position is visually apparent to ensure that the container is sealed when not in use or when it is transported, thereby preventing inadvertent leakage of possibly environmentally hazardous liquids. A further feature of the present invention is to enable the container to be emptied more completely than can be accomplished by prior pump spray devices. Yet another object of the present invention is that the wand is reliable, easy to use, inexpensive and safe.

A more complete understanding of the present invention and other advantages, objects and features thereof will be gained from a consideration of the following preferred embodiments read in conjunction with the accompanying drawings provided herein.

DETAILED DESCRIPTION OF THE INVENTION

Figure 1:
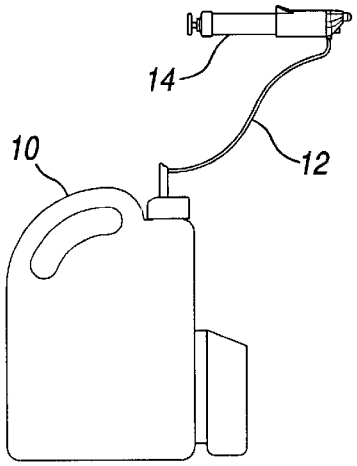
FIG. 1 is a front elevation view of a hand holdable pump spray system.

While the present invention is open to various modifications and alternative constructions, the preferred embodiments shown in the drawings will be described herein in detail. It is understood, however, that there is no intention to limit the invention to the particular forms disclosed. On the contrary, the intention is to cover all modifications, variations, equivalent structures and methods, and alternative constructions falling within the spirit and scope of the invention as expressed in the appended claims.

Referring now to FIG. 1, the hand holdable non-aerosol pump spray system is defined generally to include a container 10 acting as a liquid reservoir, to which is connected a supply tube 12 which in turn is connected to a hand holdable pump spray apparatus or wand 14. As mentioned, there are a number of advantages to having a pump placed in the wand rather than in the container as shown in the earlier patents listed above. By placing the pump in the wand, the pump is much easier to use. There is no need to release the wand nor to hold it in an awkward position when operating the pump. A user can use one hand to hold the wand 14 while the other hand draws back the pump's piston as will be explained below. When this is being done, there is no need to hold down or even to touch the container itself, unlike the previous devices, there is no need to hold the container down in opposition to an upward force on the pump because there are no additional forces acting upon the container when the pump of the present invention is manipulated. A second major feature is that manufacturing costs are reduced. This comes about in two ways. First, the placement of the pump in the wand simplifies the design and reduces the number of parts thereby reducing cost. Second, not having the pump mechanism in the container means that the disposable container is a much cheaper item to make.

Another advantage relates to the handling of liquid in the container. Because it may not be desirable to directly touch the liquid in the container 10, even though only a relatively small residual amount is left after use, it is desirable and often necessary to dispose of the container. By having the pump mechanism in the wand, the wand and the supply tube may be disengaged from the container and used again with a new, completely filled container. The wand and supply tube are simply disconnected from the spent container and the container is sealed using a simple but effective valve.

Figure 3:
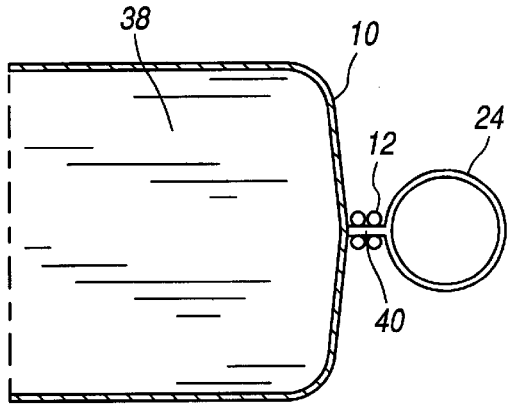
FIG. 3 is a sectional view taken along line 3—3 of FIG. 2 but without the hand holdable wand.
Figure 2:
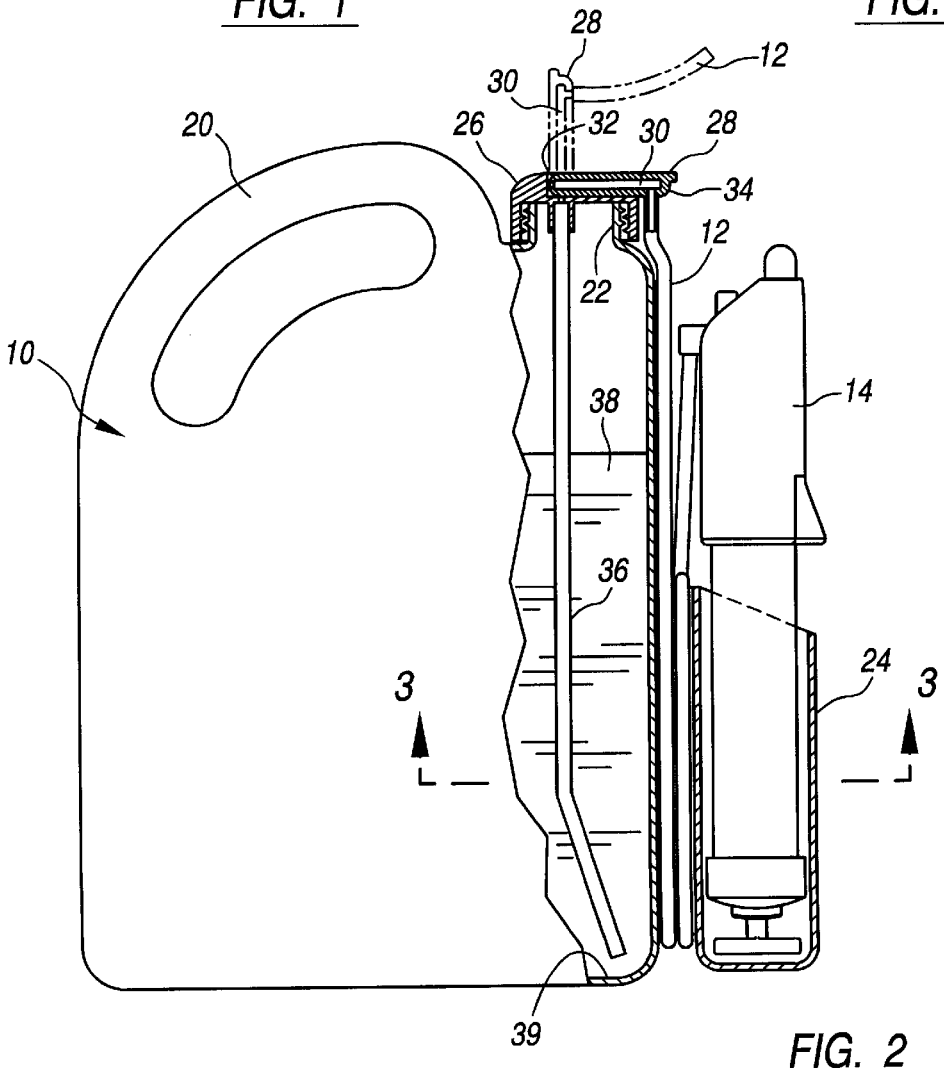
FIG. 2 is an enlarged front elevation view, partially broken away showing a hand holdable pump spray system as it would be in storage or during shipping and further illustrating a container safety valve in a closed position in solid line and in an open position in phantom line.

Referring now to FIGS. 2 and 3, the container will be described in more detail. The container may be made of any suitable synthetic resin, such as high density polyethylene, using a blow molding technique, to achieve a container having an integral handle 20, a spout 22 and a storage sleeve or compartment 24. A special safety cap 26 is also provided. This cap has a pivotal valve 28. The pivotal valve provides a safety feature. It allows a user to determine by simple visual inspection whether the valve is open or closed. The pivotal valve 28 is connected to the top of the cap 26 which in turn is attached or threaded to the container spout 22. The pivotal valve includes a central opening 30 which forms a passageway from a first end 32 of the valve toward an opposite end portion 34. Connected to the end portion 34 in any suitable fashion is the supply tube 12.

The valve is pivotally mounted to the cap. The first end 32 rotates from a position shown in solid line in FIG. 2, where the valve 28 is generally horizontal, as is the central opening 30, to a position shown in phantom line where the valve 28 is generally vertically aligned. This vertical position allows the central opening 30 to align with a liquid transferring internal tube 36 extending downwardly from the cap 26 to or very near the bottom 39 of the container 10. By having this central opening 30 aligned with the internal tube 36, there is a direct passageway between a liquid 38 in the container 10 and the wand 14. The passageway extends through the internal tube 36, the valve 28 and the supply tube 12. However, when the valve 28 is pivoted to its horizontal position, it can be seen that this passageway is closed or blocked between the internal tube 36 and the supply tube 12. This seals the liquid within the container. The pivoting valve is safe, relatively inexpensive and provides by visual inspection immediate information to a user or operator as to whether the container is open or closed.

A further advantage is that when the container is emptied, except for a residual, the container, the cap, and the internal tube may be properly discarded after the supply tube has been disconnected from the valve 28. It may now be appreciated that the elements of the system being made for disposal are simple and relatively inexpensive while the more complicated and expensive elements, such as the pump in the wand, are reuseable.

The storage/shipping sleeve 24 is provided to allow storage of the wand 14 when the system is shipped or stored. Between the sleeve and the container is an integral bridge flange 40. The flange provides a base around which the supply tube may be wrapped when the wand is placed in the sleeve. As shown in solid line in FIG. 2, the system is in condition to be shipped in a relatively compact arrangement and, of course, in a non-pressurized state. Again, this feature reduces costs and enhances safety.

Figure 4:
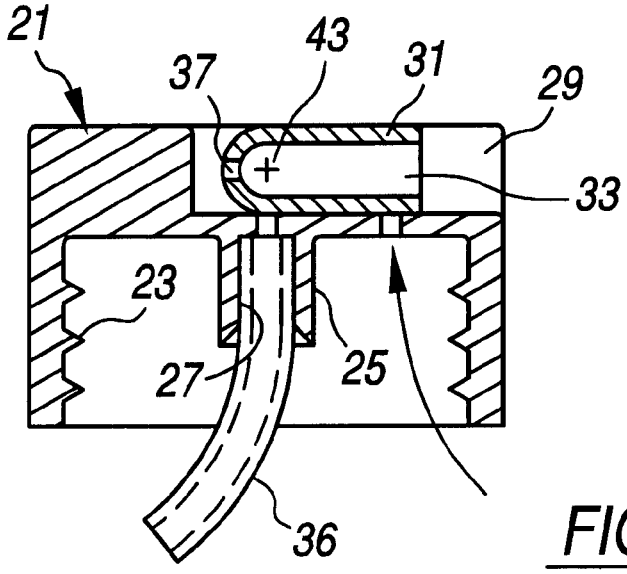
FIG. 4 is an enlarged sectional elevation view of a variation valve cap for the container, where the valve is shown in a closed position.
Figure 5:
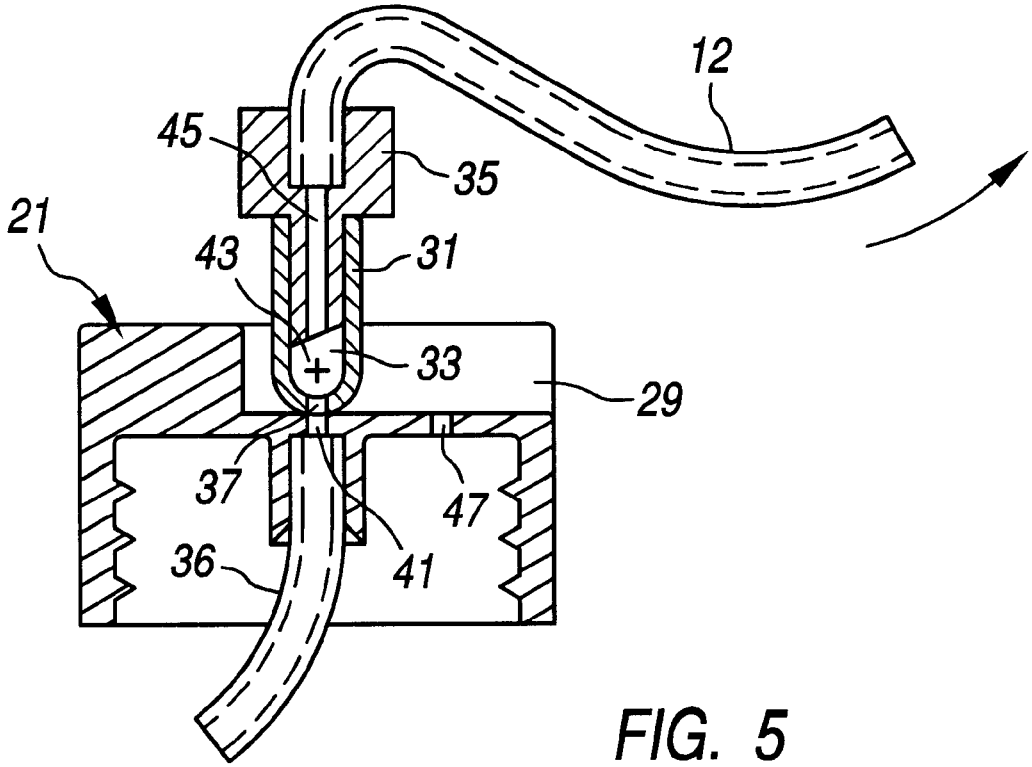
FIG. 5 illustrates the valve cap of FIG. 4 with the valve in an open position and connected to a supply tube.

Referring now to FIGS. 4 and 5, there is illustrated a variation of the cap and the valve connected to the top of the container. The modified cap 21 has an internal thread 23 for engaging a complementary thread (not shown) about the spout of the container. The cap 21 includes an integral sleeve 25 for receiving the upper end portion 27 of the internal tube 36. A slot 29 is formed in the top of the cap to which is pivotally mounted a valve element 31. The valve element 31 is generally tubular and includes a central passageway 33 for receiving a connector 35 affixed to the end of the supply tube 12. The connector has a central opening 45 and may engage the valve element 31 in the central passageway 33 as shown in FIG. 5. The valve element also includes an end opening 37 which communicates with the central passageway so that the valve element may have liquid pass through its entire longitudinal length. A vent opening 47 is also provided in the cap to allow pressure equalization during use, and a liquid opening 41 is provided to align with the internal tube 36 and the end opening 37 of the valve element 31 as shown in FIG. 5.

As with the valve embodiment in FIG. 2, the valve element 31 is closed when in the horizontal position as shown in FIG. 4. When horizontal, both the liquid opening 41 and the vent opening 47 are blocked so that the container is sealed. Also, because of the geometry of the slot 29 and the connector 35, the connector must be removed before the container is sealed. This is another safety feature because, if properly used, all of the liquid in the wand and the supply tube will be returned to the container as will be explained below.

When an operator wishes to dispense the liquid, the valve elements is pivoted upwardly about a pivot point 43 and the connector is plugged into the central passageway 33 as shown in FIG. 5. When the valve element is fully upright, there is a clear passage for the liquid in the container to the wand through the internal tube 36, the liquid opening 41, the end opening 37, the central passageway 33, the central connector opening 45, and the supply tube 12.

Referring now to FIGS. 6–9, the hand holdable pump spray apparatus is shown in more detail. The wand 14 includes a hand holdable tubular housing 44 having a first or left end portion 46 and a second or right end portion 48. Within the housing is a piston 50 movable between the first and the second end portions of the housing. Connected to the piston is a handle 54. A piston rod 52 joins the piston to the handle. The piston includes a front face 58 and a rear face 60. Between the rear face 60 of the piston and the first end portion of the housing is a first coil spring 62 which biases the piston toward the right or second end portion 48 of the housing. Attached to the left end portion 46 of the housing is a cap 64. Attached to the right end portion 48 of the housing is a nozzle 66. As will be explained below, the right end portion of the housing also contains two valves, two chambers and two springs.

Surrounding the housing about its right end portion is a trigger sleeve 68 including a thumb lever 70. Adjacent the nozzle 66 is a fluid return mechanism 72 and a connector 74 for engagement with the supply tube. Located between the front face 58 of the piston 50 and the right end portion 48 of the housing is a first or main chamber 80 into which the liquid 38 (FIG. 2) from the container is drawn when the handle 54 is moved by a user to the left or away from the cap 64. In FIGS. 6–9, the wand is shown in a relaxed or non-pressurized mode as it would be during shipment, storage or when the wand is removed from the container.

Figure 9:
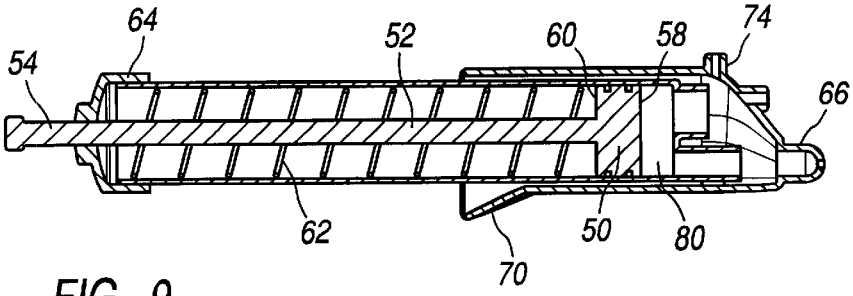
FIG. 9 is a sectional view taken along line 9—9 of FIG. 8.
Figure 10:
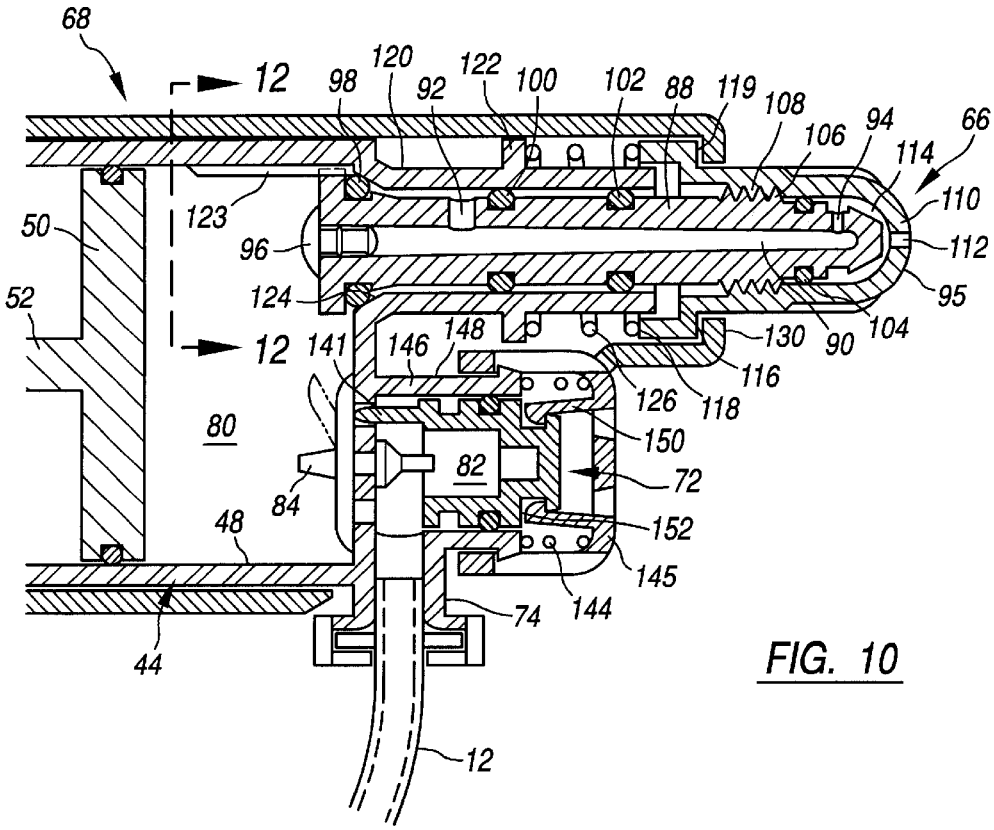
FIG. 10 is an enlarged sectional view taken within the circle 10—10 of FIG. 6 showing the valve in the apparatus in a closed position.
Figure 11:
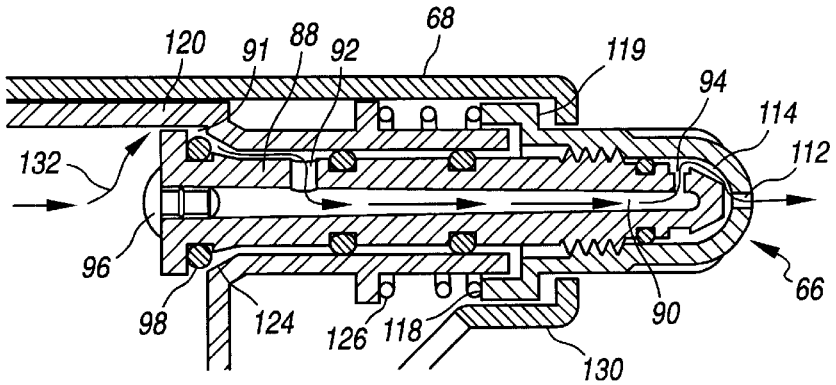
FIG. 11 is a partial view like that shown in FIG. 10 except the illustrated valve is shown in an open position.
Figure 12:
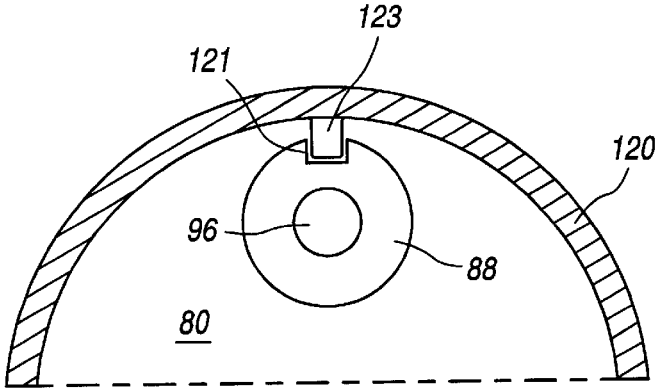
FIG. 12 is an enlarged section view taken along line 12—12 of FIG. 10.

Referring now to FIGS. 10–12, the relative simplicity and reliability of the pump and spray mechanisms may be seen. The sectional view of FIGS. 10 and 11 is of the right end portion 48 of the housing 44. The supply tube 12 is attached to the connector 74 which communicates with a second or small chamber 82. Separating the small chamber 82 from the main chamber 80 is a first or intake valve 84, commonly called a check valve, which opens in one direction usually in response to a pressure differential across the valve. As the piston 50 (FIG. 9) is pulled to the left by a user, the main chamber 80 expands. This causes the pressure in the main chamber to decrease while the pressure acting on the liquid is atmospheric, thereby creating a pressure differential across the check valve 84. The pressure differential causes the valve to open, as shown in an exaggerated phantom line, and the liquid 38 to move from the container 10 through the supply tube and the small chamber 82 into the main chamber 80. In addition, as the piston 50 is pulled to the left, the coil spring 62 (FIG. 9) is steadily compressed. When the piston reaches the limit of its travel or the user stops the leftward movement of the handle, the main chamber 80 is filled with liquid and the spring 62 is completely or partially compressed. This compressed spring provides a biasing force against the rear face 60 of the piston and the liquid, thereby closing the check valve 84.

In parallel alignment with the check valve, there is a second valve including a valve stem 88 positioned within the housing at its right end portion. The valve stem has a central longitudinal opening 90, a first or left radial passage 92 and a second or right radial passage 94 close to the valve stem nose 93. A plug 96 seals the upstream end of the longitudinal opening 90. The second valve also includes a first O-ring seal 98 positioned about the outer circumference of the valve stem. The seal acts as a valve face. There is also included a second O-ring 100, a third O-ring 102 and a fourth O-ring 104 to seal various portions of the valve. There is also an outer threaded portion 106 about the circumference of the valve stem which engages an inner thread 108 on the nozzle 66. The threaded engagement of the valve stem and the nozzle ensures that they move or slide together when an external force is applied, and yet the nozzle and the valve stem may be moved relative to one another to adjust the spray projected from the nozzle. The nozzle 66 includes a rounded head 110 having a spray opening 112. Immediately internal to the nozzle and between the nozzle and the valve stem is a third or nozzle chamber 114. The nozzle also includes a ring shoulder 116, a ring edge 118 and an external shoulder 119.

The right end portion 48 of the housing includes a first sleeve portion 120 having an annular flange 122 about the outer circumference of the sleeve portion and an oblique annular surface 124 which functions as part of the second valve by being a valve seat. Between the flange 122 and the ring edge 118 is a second coil spring 126.

Positioned about a portion of the nozzle and the sleeve portion 120 is the trigger sleeve 68 which has an annular radially directed flange 130. This flange is constructed to abut the shoulder 119 of the nozzle. If the trigger sleeve is moved to the left by a user's thumb on the lever 70, FIGS. 6 and 7, it will cause the nozzle to slide to the left thereby moving the valve stem to the left and causing the O-ring seal or valve face 98 to move away from the oblique annular surface or valve seat 124 as shown in FIG. 11. When this happens, liquid represented by the arrow 132 may move around the end of the valve stem 88, past the valve face 98 and the valve seat 124, through an annular space 91 around the valve stem 88, through the radial passage 92, then to the longitudinal opening 90, through the radial passage 94, into the nozzle chamber 114 and out of the spray opening 112. When the user removes his thumb from the thumb lever 70, the second spring 126 will push the ring edge 118 of the nozzle to the right thereby causing both the nozzle and the valve stem to also slide rightwardly, which in turn, causes the valve face 98 and the valve seat 124 to abut each other to block the flow of liquid to the nozzle chamber 114.

Referring now to FIG. 12, the valve stem 88 includes a longitudinal slot 121 for receiving a longitudinally extending key 123. This mechanism is used to allow a user to rotate the nozzle relative to the valve stem while the valve stem is kept rotationally stationary. Nevertheless, the valve stem is allowed to move in a longitudinal direction in response to the rotation of the nozzle.

Figure 13:
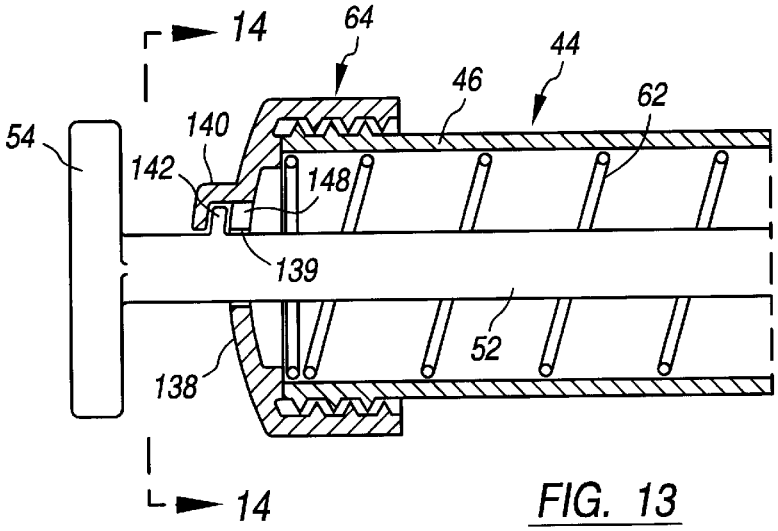
FIG. 13 is an enlarged section view taken within the circle 13—13 of FIG. 8.
Figure 14:
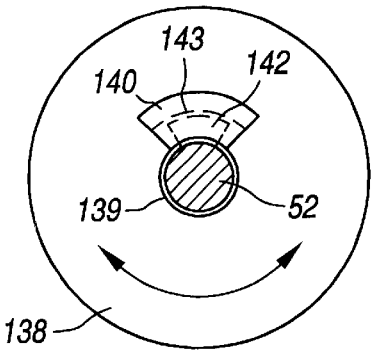
FIG. 14 is a section view taken along line 14—14 of FIG. 13 showing a handle of the hand holdable spray apparatus in a restrained position.
Figure 15:
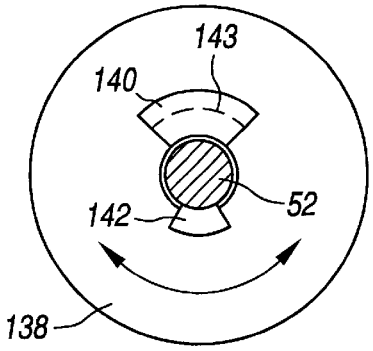
FIG. 15 is a view of the handle shown in FIG. 14 in an unrestrained position.

Referring now to FIGS. 13–15, there is illustrated another example of the elegant simplicity of the apparatus here. The left end portion 46 of the housing 44 is shown in more detail. The cap 64 is threadedly engaged with the housing and includes an outer surface 138 and a central opening 139. The central opening allows the piston rod 52 to extend beyond the end of the housing. The cap includes an arcuate flange 140 extending over an acute angle. Integral with the rod is an arcuate radially extending flange 142. When the piston 50 is in its most rightward position as generally shown in FIG. 9, the rod flange and the cap flange are in position to allow the rod flange to be trapped by the cap and the cap flange. The cap may also include a flange shape opening 143. Since the rod is cylindrical in form, it may be rotated from a trapped or restrained position as shown in FIGS. 13 and 14 to an untrapped or unrestrained position as shown in FIG. 15. In the trapped position, the pump is inoperative and unpressurized. This means that the first spring 62 is in a relaxed or almost relaxed condition. When in the restrained position, the rod flange and the opening 143 align and the rod flange slides into the opening and is restrained against rotation as well as outward linear movement. However, by backing the handle to the left and simply rotating the handle 54 a half turn, or 180°, the rod flange moves to the unrestrained position and the wand may be pressurized by the user or operator gripping the handle and pulling it to the left against the force of the compression spring.

Returning to FIG. 10 and as mentioned earlier, the liquid return mechanism 72 is provided as a safety feature to allow liquid in the main chamber 80 and the small chamber 82 to return to the container if it is not sprayed through the nozzle. This is done by forcing open the check valve 84. The liquid return mechanism includes a plunger 141, an activation button 145 and a third spring 144. The plunger 140 rides within a short second sleeve 146 of the housing 44 located in the right end portion 48. When the button 145 is pressed, it moves to the left by sliding on the outer circumference 148 of the second sleeve 146. In turn, an internal annular flange 150 of the button engages an annular shoulder surface 152 of the plunger causing the plunger to push against the check valve 84. This forces the check valve to open allowing the liquid in the main chamber 80 to enter the small chamber 82 and from there to the supply tube 12. From the supply tube, the liquid will flow back into the container 10. The driving force moving the liquid is provided by the first spring 62 (FIG. 9) applied to the rear face 60 of the piston 50.

Figure 16:
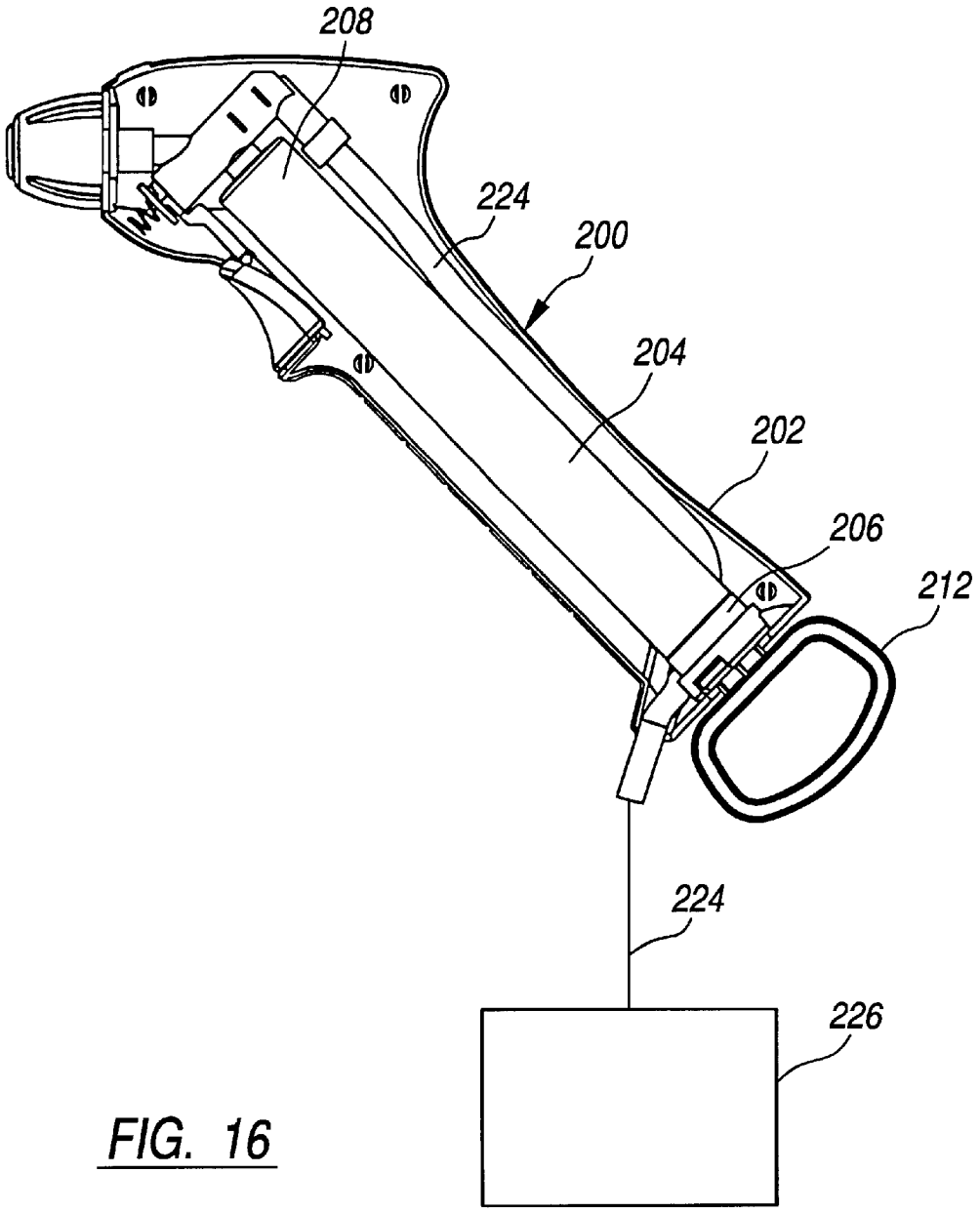
FIG. 16 is an elevation view, partially diagrammatic, of a variation of the present invention with part of the casing removed to show the internal mechanism.
Figure 17:
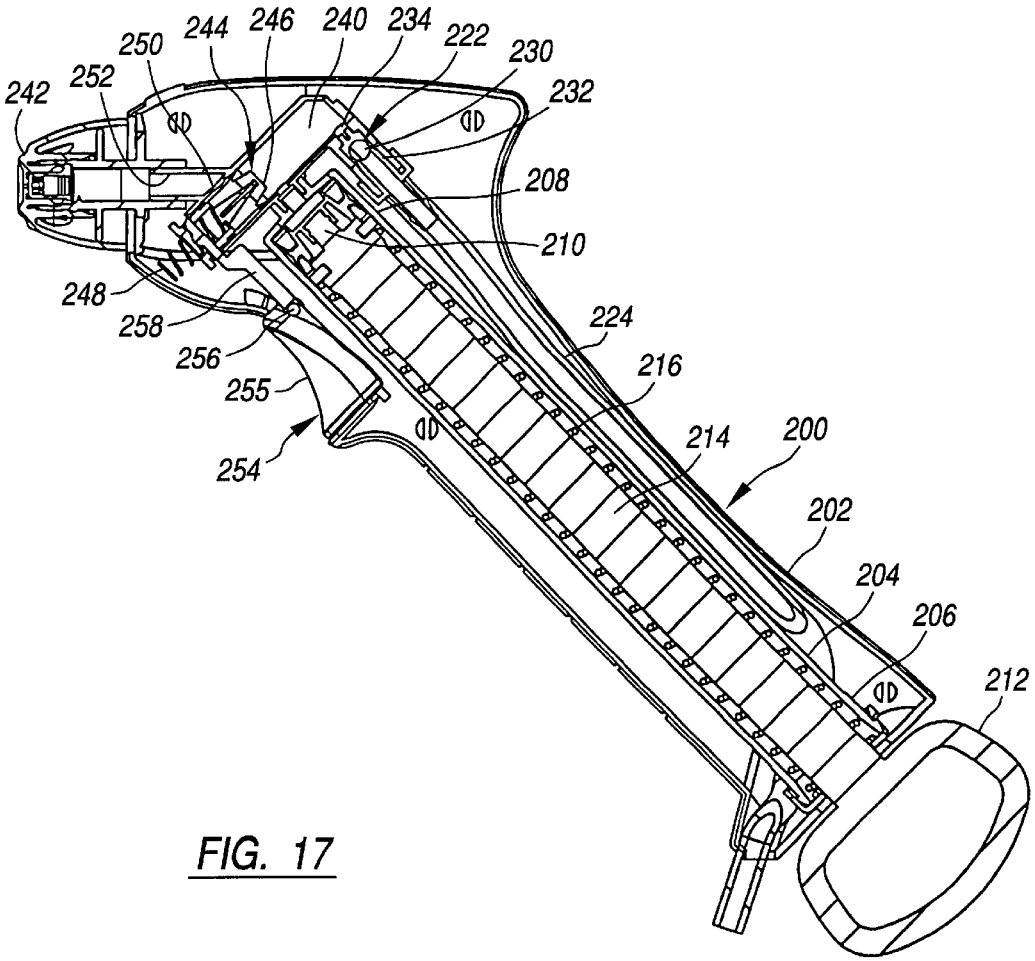
FIG. 17 is an enlarged sectional elevation view of the variation shown in FIG. 16.
Figure 18:
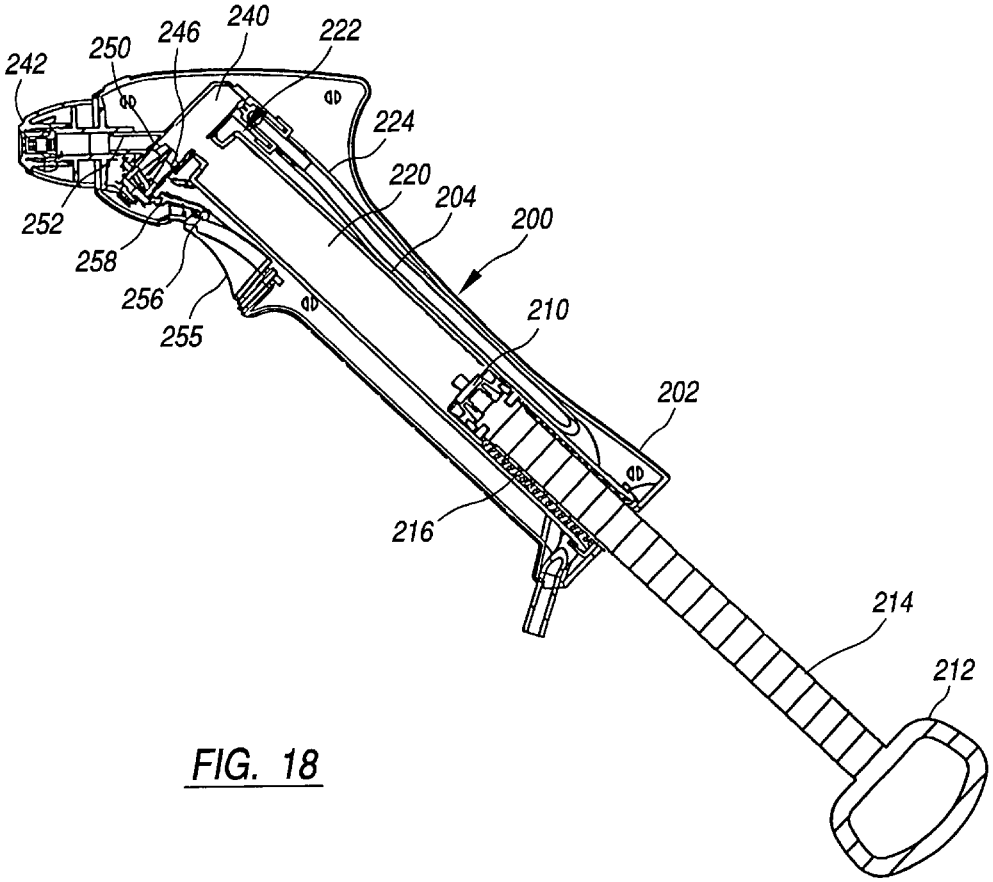
FIG. 18 is a sectional elevation view of the variation of FIG. 16 illustrating the filling of the hand holdable spray apparatus.

Referring now to FIGS. 16, 17 and 18, there is shown yet another embodiment of the present invention. Illustrated is a hand holdable pump spray apparatus 200 including one-half of an outer casing 202 within which is a cylindrical housing 204 having a first or lower end portion 206 and a second or upper end portion 208. Within the housing is a movable piston 210 which travels between the first and the second end portions of the housing. A handle 212 is connected to the piston by a rod 214. A coil spring 216 is positioned around the rod and provides a biasing force to urge the piston toward the upper end portion 208 of the housing.

As can be best seen in FIG. 18, when the handle is extended, the coil spring 216 is compressed thereby increasing the biasing force against the piston. Extending the handle also creates a chamber 220 in the housing between the upper end portion 208 and the piston 210. This chamber is filled with the fluid or liquid to be sprayed as the piston is moved to the lower end portion 206.

A first or intake valve 222 is positioned at the end of an intake conduit 224 which is shown in diagrammatic form to be connected to a reservoir 226. It is understood that the reservoir may take the form of a liquid holding container, such as the container 10 shown in FIGS. 1 and 2. And as with the earlier mentioned embodiment of the hand holdable pump spray apparatus, it is intended that the apparatus be spaced from the container or reservoir as is shown in FIGS. 1 and 16. The intake valve consists of a loose ball 230 usually seated on a valve seat 232 and constrained by a cage 234. When the handle is extended, the chamber 220 is created and is at a lower pressure than the pressure on the liquid in the reservoir 226. Because of the pressure differential, the liquid will flow through the conduit 224 unseating the ball from the valve seat 232. The liquid will flow through the cage 234 and enter a second chamber or manifold 240. From there the fluid will enter the chamber 220. In this fashion, the hand holdable pump spray apparatus is primed for operation.

Ultimately, the liquid is to be expelled through a nozzle 242. However, between the chamber 220 and the manifold 240 is a second or outlet valve 244. This valve includes a slidable valve element 246, a coil spring 248 and an opening 250 in a conduit 252 which leads to the nozzle. An actuator 254 is attached to the outer casing 202. The actuator includes an operating button 255, a pivot shaft 256 and an extended arm 258. The extended arm is connected to the slidable valve element 246 so that when the operating button 255 is depressed, it and the arm rotate in a counterclockwise direction causing the valve element 246 to slide to the left and compress the spring 248. By sliding to the left, the valve element exposes the opening 250 to the liquid in the chamber and the manifold. When the operating force on the button 255 is relieved, the coil spring 248 will bias the arm and the button to pivot clockwise thereby returning the valve element 246 to its original position as shown in FIG. 17. As can now be appreciated, the hand holdable pump spray apparatus 200 is simple, reliable and inexpensive as well as being easy to use and efficient in operation.

Figure 19:
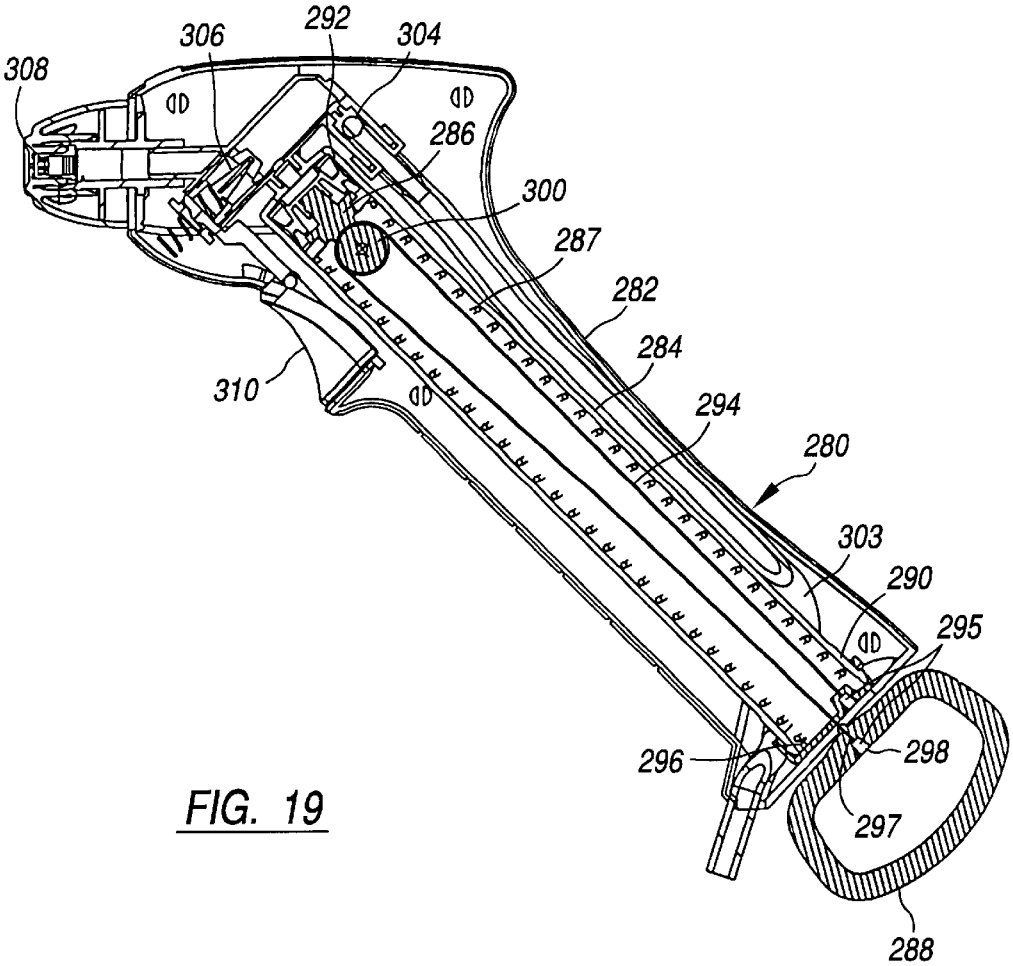
FIG. 19 is a sectional elevation view of a further embodiment similar to the embodiment shown in FIGS. 16–18 but illustrating the use of a pulley to reduce the force needed to fill the hand held spray apparatus.
Figure 20:
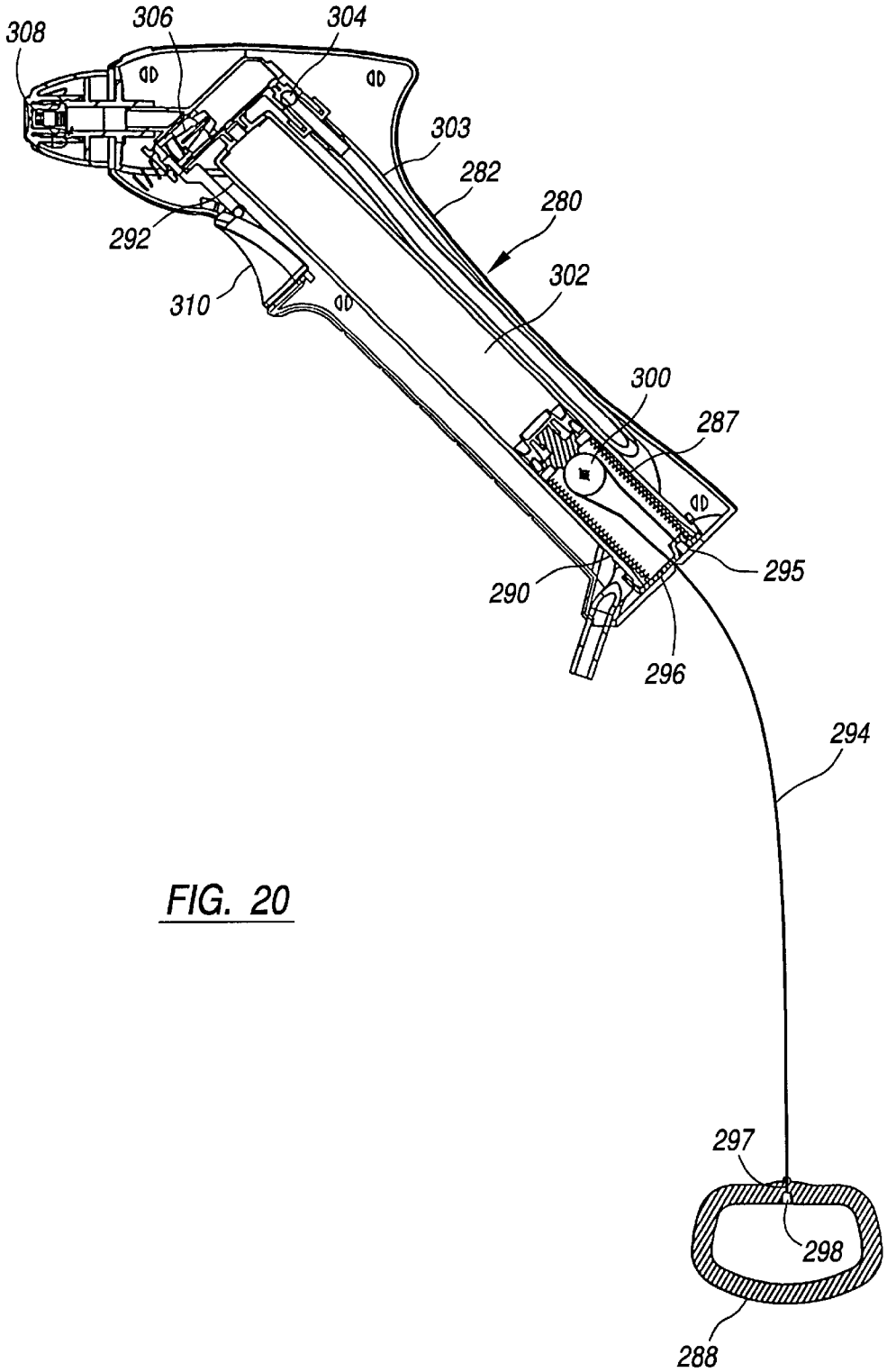
FIG. 20 is a sectional elevation view of the embodiment of FIG. 19 with the handle extended.

Referring to FIGS. 19 and 20, there is illustrated another embodiment of a hand holdable pump spray apparatus 280 which includes an outer casing 282, a cylindrical housing 284, an internal piston 286 and a handle 288. As in the previous embodiments, the housing has a first end portion 290 and a second end portion 292. The construction of the embodiment is very similar to the embodiment shown in FIGS. 16–18 except that instead of a rod connecting the piston to the handle, there is a cable 294. One end 295 of the cable is attached to a lower end 296 of the cylindrical housing while the opposite end 297 of the cable is attached to an anchor 298 in the handle. Between these two terminal points of the cable is a pulley 300 which is mounted to the piston. When an operator pulls on the handle to move the piston toward the first end portion, a low pressure chamber 302 is created and the biasing spring 287 is compressed. The advantage of the cable and pulley arrangement is that only about half of the force is required on the handle 288 to move the piston when compared to the embodiment of FIGS. 16–18.

As with the embodiment shown in FIGS. 16–18, the embodiment in FIGS. 19 and 20 includes an input conduit or tube 303, a first valve 304, a second valve 306 and a nozzle 308. Further, the embodiment of FIGS. 19 and 20 is operated by the identical actuator 310 as already described in relation to FIGS. 16–18.

Figure 21:
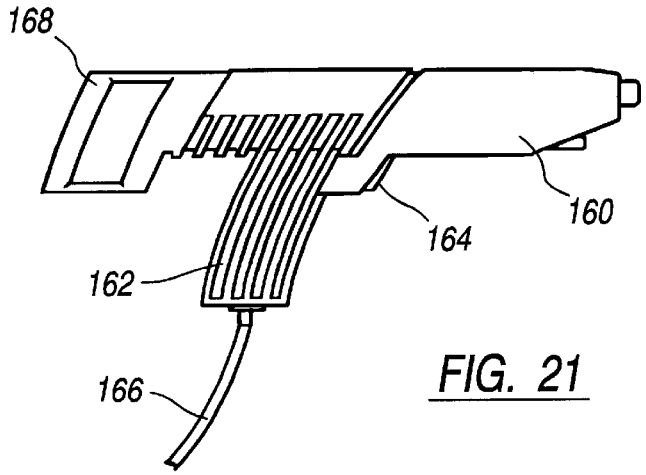
FIG. 21 is an elevation view of another embodiment of the pump spray apparatus of the present invention.
Figure 22:
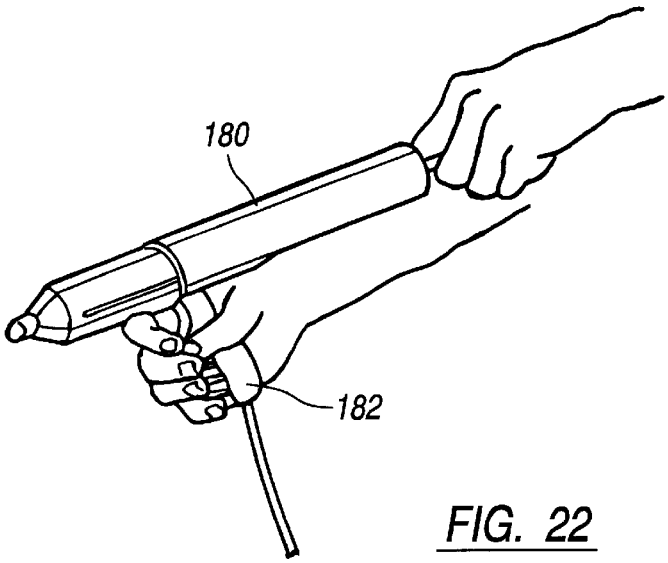
FIG. 22 is a perspective view of another embodiment of a pump spray apparatus of the present invention.
Figure 23:
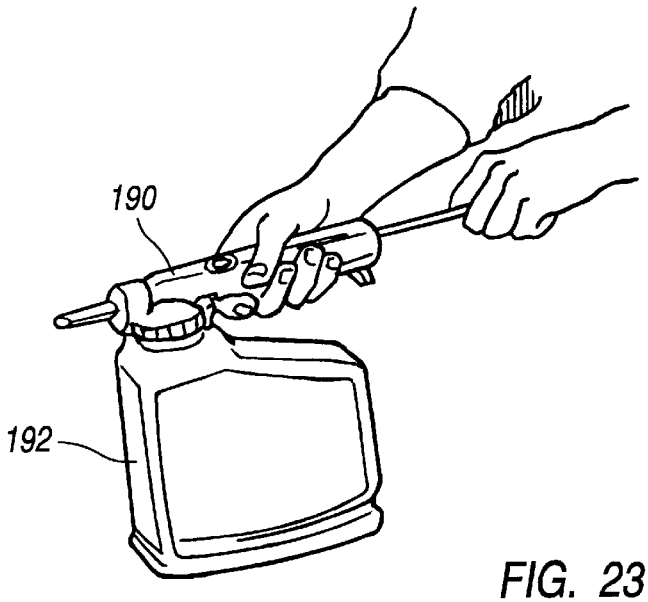
FIG. 23 is a perspective view of yet another embodiment of the present invention illustrating a pump spray apparatus attached to the top of a container.

Referring to FIG. 21, another embodiment of the wand is illustrated. This hand holdable pump spray 160 is configured with a pistol grip 162 and a trigger 164. A supply tube 166 engages the bottom of the grip. A handle 168 is designed to be visually integrated with the remainder of the wand to provide a more aesthetically pleasing unit. Referring now to FIG. 22, there is shown another embodiment of the wand. The illustrated wand 180 is similar to the wand of the FIG. 16 embodiment except that the FIG. 21 variation has a pistol grip 182. Still another embodiment is shown in FIG. 23 which is similar to the FIG. 1 embodiment except that the wand 190 is attached directly to the liquid container 192. The wand in all embodiments may be made of any suitable material such as polypropylene.

In operation of the FIGS. 1–15 embodiment, a user first removes the wand 14 from the sleeve 24 and unwraps the supply tube 12 from the bridge flange 40. The user then lifts the end 34 of the valve 28 to open the valve sealing the container. In the alternative structure the user lifts the valve element 31 to open the valve (see FIGS. 4–5) and plugs in the connector 35. Either of these actions communicates the valve with the internal tube 36, and thereby, the liquid 38 in the container 10.

Figure 6:
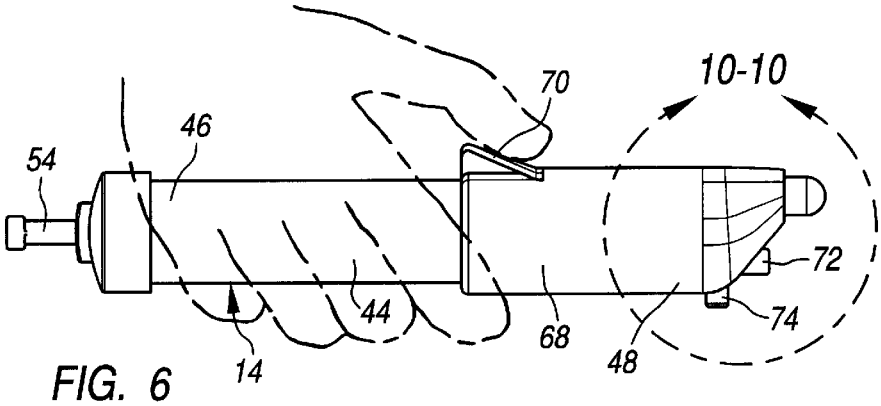
FIG. 6 is an enlarged front elevation view of an embodiment of a hand holdable pump spray apparatus.
Figure 7:
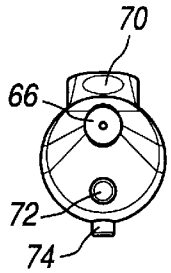
FIG. 7 is a side elevation view of the hand holdable pump spray apparatus shown in FIG. 6.
Figure 8:
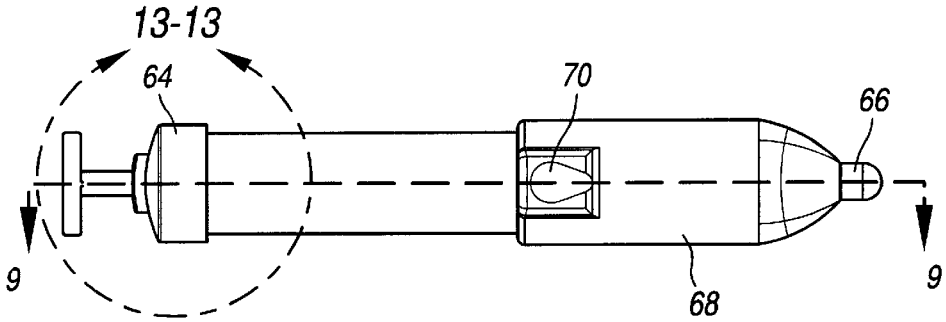
FIG. 8 is a top plan view of the hand holdable pump spray apparatus shown in FIGS. 6 and 7.

To pressurize the system, the user holds the spray apparatus housing 44 in one hand and pulls the handle outward or to the left when viewed in FIGS. 6, 7 and 9. Liquid is drawn into the main chamber 80, while at the same time the coil spring 62 is compressed. When the main chamber 80 is filled, such as when the coil spring is fully compressed, the user or operator may release the handle 54 and place his/her hand around the trigger sleeve 68 with his/her thumb on the thumb lever 70. When it is desired to actuate the system, the user pulls back on the trigger sleeve 68 causing the nozzle/valve stem combination to slide leftwardly and unseat the valve face 98 from the valve seat 124. When this is done, liquid will flow around the valve stem in the annular space 91, through the radial passage 92, through the longitudinal opening 90, out of the radial passage 94, and into the nozzle chamber 114. From there the liquid will be ejected through the nozzle opening 112. The nozzle spray may be adjusted by rotating the nozzle relative to the valve stem so as to change the relative location of the valve stem nose 93 to the nozzle opening 112. The liquid will be sprayed out of the nozzle opening 112 as long as the coil spring 62 biases the piston 50 to the right, causing the main chamber 80 to contract. When the coil spring 62 has reached its relaxed position, or if the piston is stopped such as by the shaft flange, the piston will no longer provide pressure on the liquid and the user will have to re-pressurize the wand by again moving the handle 54 to the left thereby compressing the spring 62 again, and enlarging and filling the main chamber 80. This may be done repeatedly until most of the liquid 38 has been drawn out of the container 10. At that time or before, the valve 28 or the valve element 31 may be rotated to a horizontal position to seal the container. The supply tube 12 and the wand may be removed and the container and residual liquid may be discarded. The supply tube and wand may then be reused by connecting the supply tube to a new, fully filled container.

Should the spraying operation be finished before the spring 62 has reached its relaxed position, the button 145 of the fluid return mechanism may be depressed. This causes the plunger 141 to open the check valve 84, allowing the liquid in the main chamber 80 to pass into the small chamber 82 and from there, into the supply tube 12 and back to the container. In this manner the wand is depressurized and the liquid in the wand and supply tube is once again stored in the container. Once the liquid has returned to the container the pivot valve member may be rotated to a horizontal position to seal the container. Also the supply tube may be wrapped about the bridge flange and the wand may be inserted into the storage sleeve 24.

In operation of the embodiments shown in FIGS. 16–23, loading of the hand held pump spray apparatus is occasioned by the extension of the handle whereby the piston in the cylindrical housing is moved from the second end portion to the first end portion. This creates the lower pressure formed chamber and causes the liquid in the reservoir or container to be sucked through the intake tube, into the manifold and then into the formed chamber. After the chamber is filled, the intake valve closes because of the reverse pressure differential caused by the biasing spring acting on the piston which in turn acts on the liquid to be sprayed. The liquid to be sprayed is now contained between the intake and outlet valves. When the user depresses the operating button, the outlet valve opens and the liquid in the manifold and the chamber is expelled from the hand holdable pump spray apparatus until the button is released. When this occurs, the outlet valve is closed and no further liquid is sprayed. Operating the button causes the pump spray apparatus to dispense liquid until the manifold and the chamber are evacuated at which time the user will have to recharge the apparatus by extending the handle once again.

The specification describes in detail several embodiments of the present invention. Other modifications and variations will, under the doctrine of equivalents, come within the scope of the appended claims. For example, different actuator mechanisms, valve set-ups and nozzles are considered equivalent structures as are different aesthetic designs of the casing. Also, different handles, rods, pulleys, cylinders and pistons are also equivalent structures. Still other alternatives will also be equivalent as will many new technologies. There is no desire or intention here to limit in any way the application of the doctrine of equivalents.

What is claimed is:

1. A hand holdable pump spray apparatus comprising in combination:

a housing having first and second end portions, said housing being spaced from a reservoir of fluid to be sprayed;

a piston being movable in said housing between said first and said second end portions;

a handle connected to said piston adapted to be operated by a user of said hand holdable pump spray apparatus to move said piston toward said first end portion of said housing;

a first spring operably connected to said piston to bias said piston toward said second end portion of said housing;

a chamber formed in said housing when said piston is moved toward said first end portion, said chamber being in operative communication with the spaced apart reservoir of fluid to be sprayed;

a first valve positioned between the fluid reservoir and said formed chamber, said valve being open when said handle is operated to move said piston toward said first end portion of said housing;

a nozzle operatively connected to said housing and positioned to receive fluid from said formed chamber;

a second valve separating said formed chamber from said nozzle; and an actuator operatively connected to said second valve for opening said valve to pass fluid from said chamber to said nozzle.

2. An apparatus as claimed in claim 1 including:

an outer casing, said casing enclosing said housing, said piston, said first spring, said first valve and said second valve.

3. An apparatus as claimed in claim 1 wherein:

said second valve includes a movable element, an opening and a second spring, said second spring for biasing said movable element to close said opening.

4. An apparatus as claimed in claim 1 including:

a second chamber located between said first and said second valves.

5. An apparatus as claimed in claim 1 including:

a supply conduit located within said outer casing and being connected to said first valve.

6. An apparatus as claimed in claim 1 wherein:

said actuator includes an operating button, a pivot shaft connected to said operating button and an arm for engaging said second valve.

7. An apparatus as claimed in claim 6 wherein:

said second valve includes a movable element, an opening and a second spring, said second spring for biasing said movable element to close said opening; and said arm of said actuator engages said movable element of said second valve for moving said movable element against the bias of said second spring.

8. An apparatus as claimed in claim 7 including:

an outer casing, said casing enclosing said housing, said piston, said first spring, said first valve and said second valve.

9. An apparatus as claimed in claim 8 including:

a supply conduit located within said outer casing and being connected to said first valve.

10. An apparatus as claimed in claim 9 including:

a second chamber located between said first and said second valves.

* * * * *